US005383295A

United States Patent [19]

Strattman

[11] Patent Number: 5,383,295

[45] Date of Patent: Jan. 24, 1995

[54] LUMINOUS DISPLAY DEVICE

[76] Inventor: Wayne P. Strattman, 791 Tremont St., E517, Boston, Mass. 02118

[21] Appl. No.: 994,627

[22] Filed: Dec. 21, 1992

[51] Int. Cl.[6] ..... H01J 17/16

[52] U.S. Cl. ..... 40/545; 315/326; 315/246; 313/610

[58] Field of Search ..... 40/545, 615; 362/255; 313/634, 573, 610; 315/246, 326; 345/60; 446/485

[56] References Cited

U.S. PATENT DOCUMENTS

| | | | |
|---|---|---|---|
| 2,158,968 | 5/1939 | Moffat | 176/14 |
| 3,190,178 | 6/1965 | McKenzie | 40/615 X |
| 3,405,025 | 10/1968 | Goldman | 40/615 X |
| 4,403,831 | 9/1983 | Amano | 345/60 X |
| 4,584,501 | 4/1986 | Cocks et al. | 313/493 |
| 4,703,574 | 11/1987 | Garjian | 40/545 |
| 4,742,278 | 5/1988 | Iannini | 315/248 |
| 4,990,826 | 2/1991 | Cocks et al. | 313/485 |
| 5,036,243 | 7/1991 | Cocks et al. | 313/39 |
| 5,051,648 | 9/1991 | Misono et al. | 313/634 X |
| 5,089,745 | 2/1992 | Iannini | 446/485 X |
| 5,126,632 | 6/1992 | Parker | 313/634 |
| 5,281,898 | 1/1994 | Albright | 315/246 X |

FOREIGN PATENT DOCUMENTS

| | | | |
|---|---|---|---|
| WO82/00919 | 3/1982 | WIPO | 40/545 |

*Primary Examiner*—Peter Nerbun
*Attorney, Agent, or Firm*—Kenway & Crowley

[57] ABSTRACT

A luminous display device which includes a fused assembly of three flat members, behind the first of which a chamber partly defined by an opening in the second of said members is formed, a quantity of beads and an ionizable gas being disposed in said chamber, a source of high frequency voltage being connected to an electrode through an opening in the third of said members to form myriad discharge paths throughout said chamber.

2 Claims, 2 Drawing Sheets

LUMINOUS DISPLAY DEVICE

This invention relates in general to flat plate luminous display devices, and in particular to such devices which incorporate plasma discharges in inert gases.

BACKGROUND OF THE INVENTION

Luminous display devices are widely used for decorative or attention-getting purposes. The most common are probably those which are made up of simple or complex lengths of tubing filled with an inert gas such as neon, argon, mercury vapor, or mixtures thereof. Also rather common are flat display devices which may serve as lighted signs having at least one transparent surface which may be masked to create letters, figures, or characters. Generally, these include two flat plates which are spaced from each other to form a chamber which is evacuated and then filled with the desired inert gas. Electrodes are arranged in such a manner as to set up a discharge path or paths in the chamber, and voltage is applied to cause ionization of the gas to produce a color display. This invention is concerned with luminous display devices of the flat plate type, but having a movable pattern of light display.

The primary object of the present invention is the improvement of performance, structural strength, and durability of flat luminous display devices.

Another object is a flat plate luminous display device operational from a simple power supply of radio-frequency voltage to produce attractive light patterns.

A further object of the present invention is the incorporation of elements between the plates of a luminous display device which facilitate its manufacture and set up various paths for gas discharge.

SUMMARY OF THE INVENTION

A sandwich of three glass or plastic plates is fused together, the surface of the front plate being a continuous plane, the second being of the same shape as the first but having a major portion of its central are a removed, and the third, like the first, being formed as a continuous plane except for a relatively small hole forming a restricted passage through the plate. The hole thus provides the only access to the interior volume formed within the assembled plates. To remove air and inject gas, a tubulation is sealed over the hole. An electrode is inserted in the tubulation, and, after the insertion of gas, the extremity of the tubulation is flattened and sealed over leads extending from the electrode to the exterior in the manner of a conventional stem press used in incandescent lamps.

The leads serve to support the electrode in position within the tubulation and also to apply voltage to the electrode. The invention includes a quantity of frit or beads which fills the interior volume created within the plates and serves as a separator and uniform space between plates as well as to form a multitude of discharge channels. These beads may be of clear, colored, or phosphor-coated glass to provide any desired color in the display. For a better understanding of the present invention, reference should be made to the description of preferred embodiments, which should be read with reference to the above-identified figures of the appended drawing.

DESCRIPTION OF PREFERRED EMBODIMENTS

Figure 1:
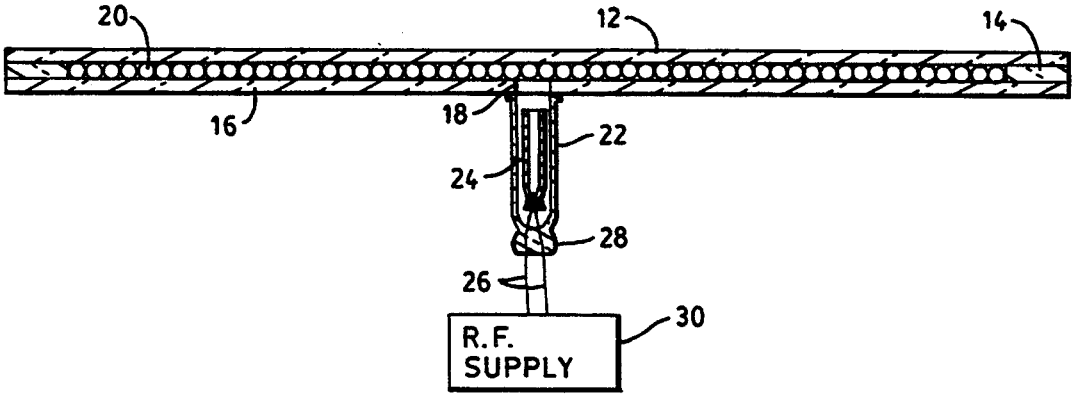
FIG. 1 is a sectional view of a luminous display device constructed in accordance with the present invention.

In FIG. 1, there may be seen a flat glass plate 12 which may be composed of any of several types of relatively high melting-point glass. The plate may be square, rectangular, or of any desired shape, although for purposes of explanation, the present embodiment will be assumed to utilize a circular plate. The plate 12 is preferably transparent, although other display effects may be had or enhanced by the use of frosted or other translucent material.

Fused to the transparent surface plate 12 is a second plate 14, which may be of the same material, size and shape as the plate 12, but which has its major central portion removed. In other words, the plate 14 is in the shape of a flat washer. Fused to the plate 14 is a third plate 16 similar in all respects to the plate 12, but having a relatively small opening formed therethrough. The location of the opening is not critical, but for convenience it may be axial, forming a central passage 18. During the assembly of the plates for fusing, a quantity of glass beads 20 is provided to fill the interior volume formed within the three plates. If a single layer is used, the beads are of a diameter approximately equal to the thickness of the second plate 14. The beads or frit serve dual mechanical and electrical purposes as explained in greater detail hereinbelow. A tubulation 22 is sealed to the bottom surface of the plate 16 with its interior communicating with the interior volume through the passage 18. The tubulation may be attached after the fusing of the relatively high melting point glass of the plates by utilizing a relatively low melting point glass or a solder glass seal.

The tubulation 22 is ultimately formed into a press in a manner similar to that employed in sealing and providing for stem support in a conventional incandescent bulb. That is, an electrode 24 having attached leads 26 is supported in the tubulation by means of the stem press 28. As is well known in the art, the leads are made of a material or coated with material having an expansion rate compatible with that of the glass of the stem press 28, which is pressed down upon the leads when in a molten state to form a seal when hardened.

The display device is fabricated by first cutting, drilling, and assembling the plates 12, 14 and 16 together with a single layer of beads disposed in the interior volume. The plates are then fused at a temperature controlled to reach the fusing temperature of the glass but not sufficient to cause significant deformation or collapse of the outer plates which could affect the volume created by the outer plates and within the center plate. The inserted layer of glass beads of course serves to resist collapse of the outer surface plates, especially during the fabrication process. When the device is completed, the layer of beads 20 serves to maintain uniform spacing between central areas of the wall formed by a surface of the third plate and the central areas of the confronting wall of the front plate. After the fusing of the plates, the tubulation may be attached utilizing solder glass and sealing at a temperature well below that used for the fusing of the plates.

After the attachment of the tubulation 22, the interior volume is evacuated by a suitable mechanical or diffusion pump to a pressure of about 15 microns. Gases of any desired type depending upon the color or brilliance of display desired are introduced into the volume through the tubulation, following which the electrode 24 mounted on the leads 26 is inserted in the tubulation 22. The end of the tubulation is softened and flattened to form the stem press 28 from which the electrode 24 is supported within the tubulation 22.

A power supply 30 with suitable switching produces voltage in the kilovolt range of about one-to-seven thousand or higher and a frequency of approximately 20,000–50,000 Hz. or higher. The high frequency voltage causes the gases to ionize, despite the fact that it is applied only to the single electrode 24 in the device. This occurs because there exists sufficient capacitance between the ionized gas and ground to permit ionization.

Figure 2:
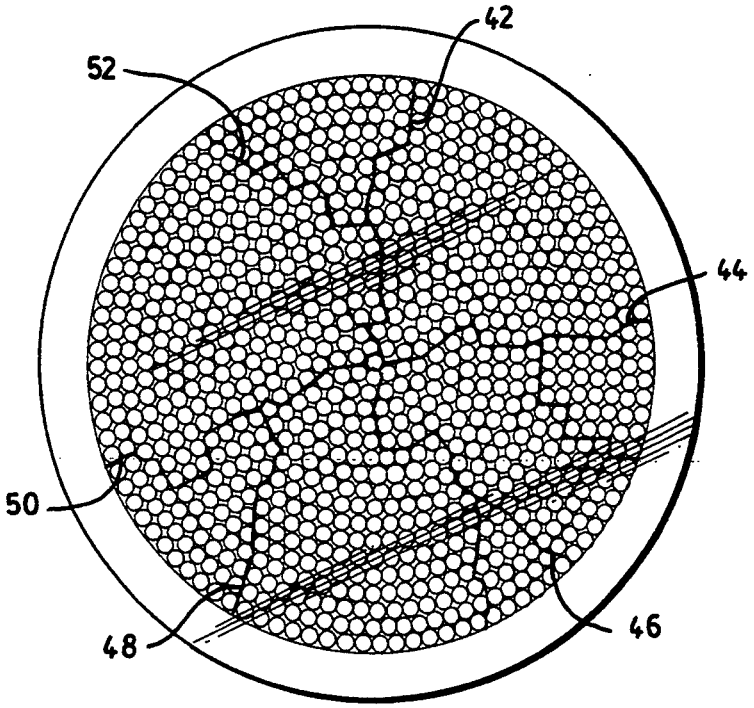
FIG. 2 is an elevation showing on the display surface of an embodiment of the present invention a first color pattern.
Figure 3:
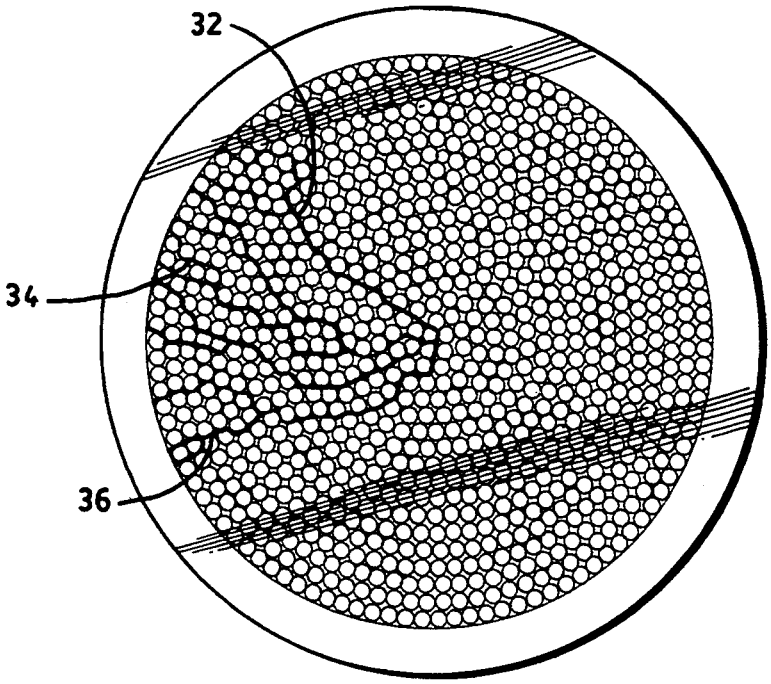
FIG. 3 is a view similar to that of FIG. 1 showing an alternative color pattern.

In FIGS. 2 and 3, two different output displays are shown. In FIG. 2, the fingers of light discharge extend as at 32, 34 and 36 radially outward from the center of the left quadrant. In FIG. 3, the fingers are moving about the periphery as at 42, 44, 46, 48, 50, and 52. Because the presence of the glass beads creates a multitude of small channels in the intersticial spaces, the electrical discharge tends to shift and dim and brighten in a random fashion. Although the display effects are random in nature, higher pressures tend to stabilize the display; higher voltages tend to lengthen the radially extending fingers of the display; and higher frequencies tend to cause appearance of finer lines and faster movements.

Different color effects in the displays may also be obtained by varying the gas fill or type of beads utilized in the discharge volume. For example, the beads themselves may be made of clear or colored glass. Alternatively, the beads may be phosphor-coated and the volume may be filled with a gas which produces ultraviolet radiation, which will serve to excite the phosphor coatings from the application of voltage to the electrode of the device.

What is claimed is:

1. A luminous display device comprising a sandwich of first, second and third plates fused together, the first and third plates being substantially similar and the second plate having a major portion of its central area removed, whereby a relatively flat chamber constituting an interior volume is formed, a layer of beads being distributed throughout said interior volume whereby myriad paths through said volume are formed, an ionizable gas filling said interior volume, said third plate having an opening formed therethrough providing restricted access to said interior volume, and means for initiating ionization of said gas including a tubulation sealed centrally to said third plate and having an internal opening in communication with said opening formed in said third plate, an electrode mounted on leads sealed in said tubulation, and a source of electrical power connected to said leads.

2. A luminous display device as defined in claim 1 wherein said source of electrical power comprises a generator of voltage in the range of kilovolts at a frequency in excess of approximately 20 kilohertz.

* * * * *